United States Patent [19]

Dillabough

[11] Patent Number: 4,631,986

[45] Date of Patent: Dec. 30, 1986

[54] STUD REMOVING AND TRANSFER ADAPTION MODE

[76] Inventor: Robert J. Dillabough, 21 Nadina, Kitimat, B.C., Canada, V8C-2A3

[21] Appl. No.: 697,713

[22] Filed: Jan. 31, 1985

[51] Int. Cl.[4] ..... B25B 13/50; C25D 17/00

[52] U.S. Cl. ..... 81/53.2; 81/176.2; 204/225

[58] Field of Search ..... 81/53.2, 124.2, 124.3, 81/121.1, 176.1, 176.15, 176.2, 488; 411/349, 549, 553; 266/287; 204/297 R, 225, 245

[56] References Cited

U.S. PATENT DOCUMENTS

| | | | |
|---|---|---|---|
| 2,197,283 | 4/1940 | Ward | 81/124.3 |
| 3,094,022 | 6/1963 | Young | 81/53.2 |
| 3,727,491 | 4/1973 | Buckwalter | 81/53.2 |

FOREIGN PATENT DOCUMENTS

| | | | |
|---|---|---|---|
| 1024254 | 6/1983 | U.S.S.R. | 81/176.1 |

*Primary Examiner*—Frederick R. Schmidt
*Assistant Examiner*—Debra S. Meislin
*Attorney, Agent, or Firm*—Fetherstonhaugh & Co.

[57] ABSTRACT

A system for pulling a stud electrode from its retaining base in a pot smelter for the smelting of aluminum. An upper end of the stud is engaged with a spigot attached to a puller and the stud is twisted with the puller to loosen it. There is a pair of opposed longitudinal channels on the exterior of the stud, open at the end of the stud. A pair of opposed further longitudinal channels on the exterior of the stud are closed at the end of the stud and generally parallel to the first longitudinal channel. A pair of opposed circumferential channels join the longitudinal channels. A socket is mounted on the spigot to engage the stud. The socket has a generally cylindrical, hollow body to fit over the stud. Teeth in the socket are positioned to engage the longitudinal channels and to pass along the circumferential channels. The stud may be turned to free it from the base and lifted with the teeth engaging the longitudinal channel.

7 Claims, 9 Drawing Figures

STUD REMOVING AND TRANSFER ADAPTION MODE

FIELD OF THE INVENTION

This invention relates to a system for pulling a stud electrode from its retaining base in a pot smelter for the smelting of aluminum.

DESCRIPTION OF THE PRIOR ART

In the manufacturing of aluminum the ore is processed in pots by electrolytic action and the necessary current of electricity is applied to studs, which are embedded in a carbon base. There can be 60 pots in one building, set out in pot lines with the current flowing constantly through the pots. The average pot has about 30 studs.

Each pot line has its own overhead travelling crane which have a variety of functions including pulling and moving the studs. This pulling and moving of the studs is carried out continuously. There can be about 300 studs pulled and replaced in a single day in one pot line. The number of pot lines is limited only by the size of a plant's operation. Twelve, fifteen and even more pot lines may be found in one aluminum smelting plant.

The pulling of the studs is carried out by a stud puller attached to the travelling cranes. The puller can be lowered and turned to loosen the stud and then to remove it from the carbon base.

The existing method of pulling studs is not entirely satisfactory. It entails the use of a clevis or gripping head. This gripping head has more than 30 moving parts, with consequent breakdowns of the various components. These breakdowns necessitate changes of the gripping head so that the defective head may be worked on. Thus maintenance is frequent and costly. Furthermore with the existing method of stud pulling there is the marked disadvantage that these types of heads can drop the studs during transfer. A single stud weighs somewhere from 600 to 900 pounds and has a length of about 6 to 9 feet.

SUMMARY OF THE INVENTION

The present invention seeks to produce a system of pulling a stud that is greatly simplified compared with the prior art and offers additional security both in the twisting operation and, in particular, in the subsequent lifting and carrying operation.

Accordingly the present invention is in a system for pulling a stud electrode from its retaining base in a pot smelter for the smelting of aluminum by engaging an upper end of the stud with a spigot attached to a puller and twisting the stud with the puller to loosen it the improvement comprising: (a) a pair of opposed first longitudinal channels on the exterior of the stud, open at the end of the stud; a pair of opposed second longitudinal channels on the exterior of the stud, closed at the end of the stud and generally parallel to the first longitudinal channel; a pair of opposed circumferential channels, each circumferential channel communicating a first channel and a second channel at the ends of the first and second channels remote from the end of the stud; (b) a socket mounted on the spigot to engage the stud comprising a generally cylindrical, hollow body to fit over the stud; opposed internal teeth in the socket and positioned to engage the first longitudinal channels, to pass along the circumferential channel and to engage the second longitudinal channel whereby the stud may be turned to free it from the base and lifted with the teeth engaging the second longitudinal channel.

DRAWINGS

Aspects of the invention are illustrated, merely by way of example, in the accompanying drawings in which.

DESCRIPTION OF THE PREFERRED EMBODIMENTS

Figure 1:
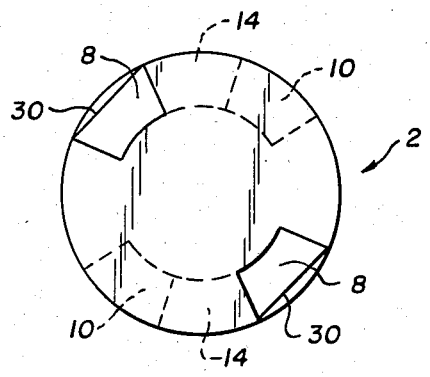
FIG. 1 is a top view of a stud according to the present invention.
Figure 2:
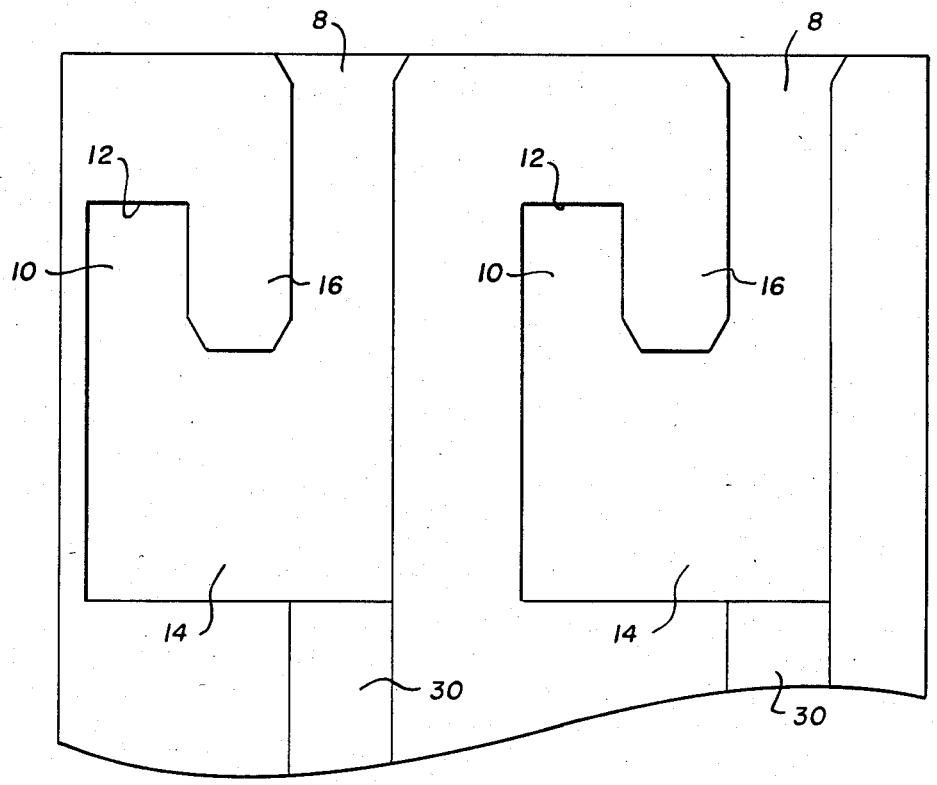
FIG. 2 is a relative view showing the stud circumference.
Figure 3:
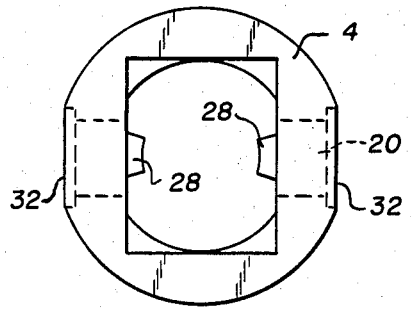
FIG. 3 is a top view of the socket according to the present invention.
Figure 4:
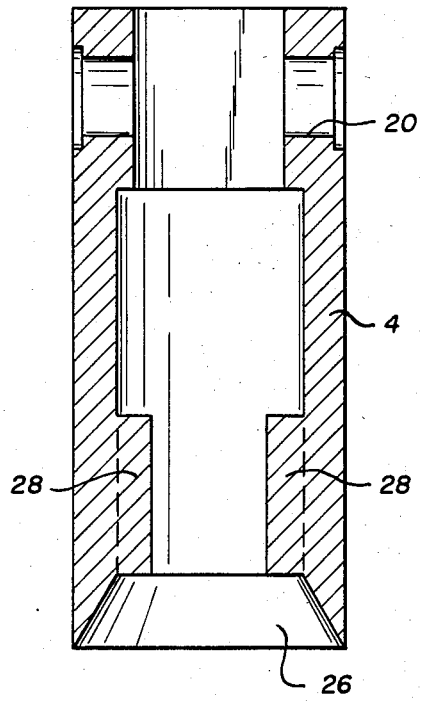
FIG. 4 is a cross section through the socket.
Figure 9:
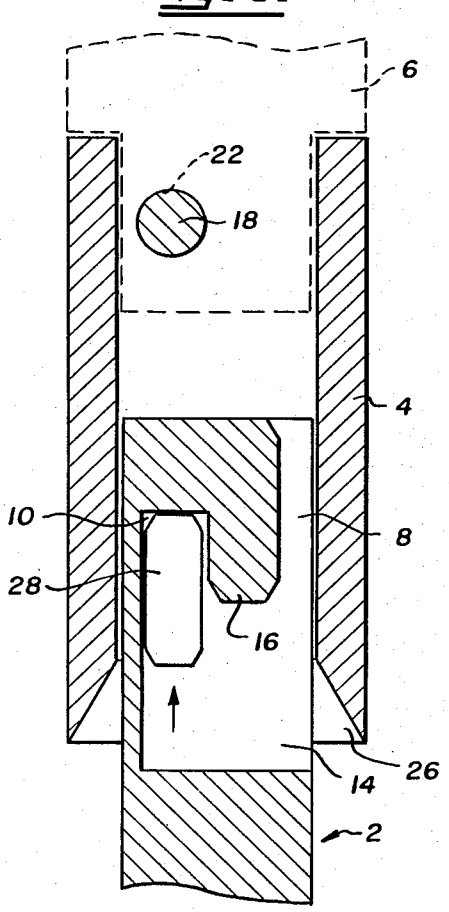
FIGS. 7 to 9 are details illustrating the operation of the system according to the present invention.
Figure 8:
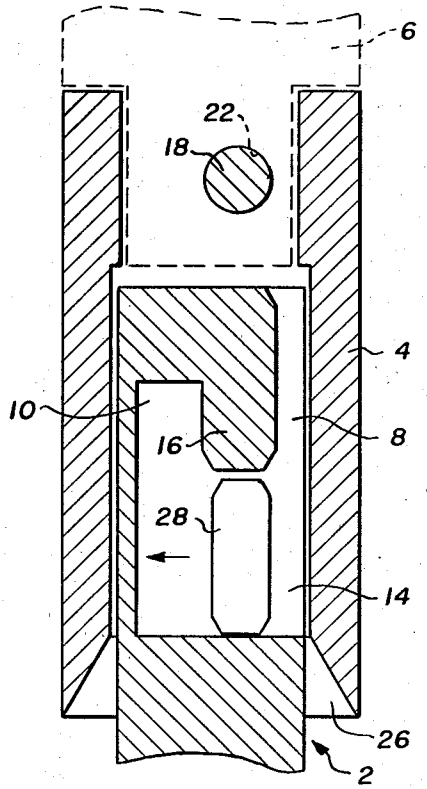
Figure 7:
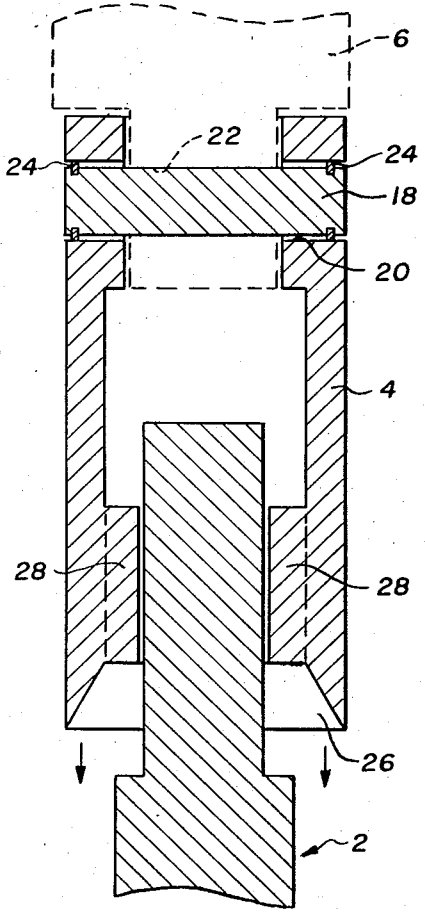

The drawings show a system, shown complete in FIGS. 7 to 9, for pulling a stud electrode 2 from its retaining base in a pot smelter for the smelting of aluminum. The system operates by engaging the stud 2 with a socket 4 attached to a spigot 6 and twisting the stud 2 with the socket 4 to loosen it. Spigot 6 is attached to a conventional puller, not shown. As shown in FIGS. 1 and 2 according to the invention the stud 2 is provided at one end with a pair of opposed first longitudinal channels 8 on its exterior, open at the end of the stud 2.

There are opposed, second longitudinal channels 10 on the exterior of the stud 2, closed at 12 and generally parallel to channels 8. There is a pair of opposed circumferential channels 14 joining channels 8 and 10. Downwardly extending projections 16 act to define the channels 14.

Socket 4 is mounted on conventional spigot 6, as shown particularly in FIG. 7. As shown in that Figure the socket 4 is mounted to the spigot 6 by a pin 18 engaging in openings 20 in the socket 4 and a lined opening 22 in the spigot 6. The pin 18 is retained in place by circlips 24 at its end, in conventional manner.

As shown in FIGS. 3 to 6 the socket 4 comprises a generally cylindrical, hollow body able to fit over the stud 2. To facilitate the fitting over the stud 2 the socket 4 is desirably provided with a chamfered lower end 26 as shown particularly in FIG. 4.

The socket 4 is provided with opposed internal teeth 28 able to engage the longitudinal channels 10 in the stud 2. Furthermore the socket 4 is able to turn the stud 2, by abutting it, once it has entered the longitudinal channels 10, to free the stud from the base.

As shown particularly in FIG. 1 there are flats 30 formed on the exterior of the stud 2 to indicate the position of the first longitudinal channels 8. This is desirable for a crane operator to be able to see the positioning of the socket 4 on the stud 2. Furthermore there are desirably flats 32 formed on the exterior of the socket 4 to indicate the internal position of the teeth 28, note particularly FIG. 5.

Figure 6:
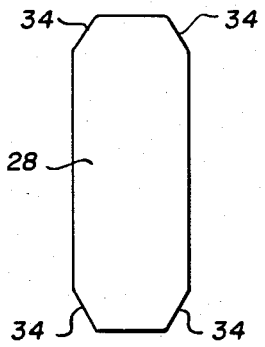
FIG. 6 is a detail of a tooth of the socket.
Figure 5:
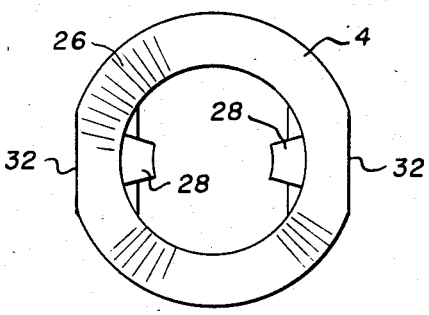
FIG. 5 is a bottom view of the socket.

FIG. 6 shows that the teeth are formed with chamfered edges 34 to facilitate entry into the channels 12 and turning of the teeth 28 within the stud once the socket and stud are engaged.

To use the system according to the present invention the socket 4, mounted on the spigot 6, is moved in position over the stud 2 and lowered as shown in FIG. 7. Once properly positioned the socket 4 is turned so that the teeth 28 abut the internal surface of the stud 2 to turn it. The turning loosens the stud 2 from its carbon base. At that stage the teeth 28 engage the second channels 10 as shown in FIG. 9 and the stud may be lifted from the base. It may then be moved with ease and safety.

The system of the present invention is useful with conventional apparatus. When the head of a stud wears out it is removed by sawing it off and a new head, already formed, is flash butt welded to the old stud. To use the system of the present invention the new improved stud may simply be used as a new stud head.

Again the socket can be attached to the existing spigot by the simple provision of the aligned openings 20 and 22 and pin 18.

The present invention thus provides a greatly simplified system of pulling a stud electrode at its retaining base in a pot smelter. The system is mechanically simpler but also safer than the prior art.

I claim:

1. In a system for pulling a stud electrode from its retaining base in a pot smelter for the smelting of aluminum by engaging an upper end of the stud with a spigot attached to a puller and twisting the stud with the puller to loosen it the improvement comprising:

(a) a pair of opposed first longitudinal channels on the exterior of the stud, open at an end of the stud;

a pair of opposed second longitudinal channels on the exterior of the stud, closed at the end of the stud and generally parallel to the first longitudinal channel;

a pair of opposed circumferential channels, each circumferential channel communicating one of said first with one of said second longitudinal channels at the ends of the first and second channels remote from the end of the stud;

(b) a socket mounted on the spigot to engage the stud comprising a generally cylindrical, hollow body to fit over the stud;

opposed internal teeth in the socket and positioned to engage the first longitudinal channels, to pass along the circumferential channels and to engage the second longitudinal channels whereby the stud may be turned to free it from the base and lifted with the teeth engaging the second longitudinal channels.

2. A system as claimed in claim 1 in which the socket is pivotally mounted on the spigot.

3. A system as claimed in claim 1 in which the socket is pivotally mounted on the spigot by a pin extending through the socket and the spigot.

4. A system as claimed in claim 1 in which there are flats formed on the exterior of the stud to indicate the positions of the first longitudinal channels.

5. A system as claimed in claim 1 in which there are flats formed on the exterior of the socket to indicate the internal position of the teeth.

6. A system as claimed in claim 1 in which the teeth in the socket are chamfered to facilitate entering into the first and second longitudinal channels in the stud.

7. A system as claimed in claim 1 in which the socket has chamfered edges at its outer end to facilitate its engaging on the stud.

* * * * *